US006899002B2

(12) United States Patent
Willis, Sr.

(10) Patent No.: US 6,899,002 B2
(45) Date of Patent: May 31, 2005

(54) APPARATUS FOR INSTALLING AND REMOVING SINK STRAINER NUTS

(76) Inventor: Charles E. Willis, Sr., 5844 Belvidere St., Detroit, MI (US) 48213

( * ) Notice: Subject to any disclaimer, the term of this patent is extended or adjusted under 35 U.S.C. 154(b) by 0 days.

(21) Appl. No.: 10/666,721

(22) Filed: Sep. 18, 2003

(65) Prior Publication Data

US 2004/0060399 A1 Apr. 1, 2004

Related U.S. Application Data

(60) Provisional application No. 60/411,469, filed on Sep. 18, 2002.

(51) Int. Cl.[7] ..... B25B 23/16
(52) U.S. Cl. ..... 81/177.7; 81/177.8; 81/176.15
(58) Field of Search ..... 81/177.7, 177.8, 81/176.15, 176.2

(56) References Cited

U.S. PATENT DOCUMENTS

| | | | | |
|---|---|---|---|---|
| 2,801,561 | A | 8/1957 | Bonner | |
| 6,148,698 | A * | 11/2000 | Hsieh | 81/177.8 |
| 6,202,515 | B1 * | 3/2001 | Denton | 81/177.1 |
| 6,295,898 | B1 * | 10/2001 | Hsieh | 81/177.8 |
| 6,330,840 | B1 * | 12/2001 | McCormick et al. | 81/57.3 |
| 6,745,650 | B1 | 6/2004 | Chang | |

* cited by examiner

*Primary Examiner*—Joseph J. Hail, III
*Assistant Examiner*—Alvin J. Grant
(74) *Attorney, Agent, or Firm*—Butzel Long

(57) ABSTRACT

An apparatus for installing and removing a fastener such as a sink strainer nut includes a collar portion and a handle portion pivotally attached to the collar portion. The collar portion defines a plurality of cutouts and engaging surfaces for engaging with lugs on a sink strainer nut.

16 Claims, 6 Drawing Sheets

APPARATUS FOR INSTALLING AND REMOVING SINK STRAINER NUTS

CROSS-REFERENCE TO RELATED APPLICATION

This application claims the benefit of U.S. provisional patent application Ser. No. 60/411,469 filed Sep. 18, 2002.

BACKGROUND OF THE INVENTION

The present invention relates generally to a plumbing tool and, in particular, to an apparatus for installing and removing plumbing fittings such as sink strainer nuts.

Sink strainer retaining nuts are utilized to attach a sink strainer, such as for a kitchen sink or the like, to the underside of the sink. The sink strainer includes a lower end extending through the sink bottom and having threads thereon for engaging with the retaining nut. The lower end of the sink strainer connects to a trap and to drain piping.

Typically, the sink strainer retaining nut is difficult to remove. One method is to use a hammer to drive a cold chisel or screwdriver against the lugs on the nut to break the nut loose. This method, however, is both time-consuming and expensive, because after using a cold chisel or screwdriver, a lug or lugs may be broken, requiring the nut to be replaced and increasing the time required to complete the job. Another method for removing the retaining nut is to utilize a spanner-type wrench to engage the lugs. This method, however, also proves difficult because of wrench slippage due to poor contact with only few of the lugs of the nut as well as lack of space in which to work, which also increases the time required to complete the job.

It is desirable, therefore, to provide an apparatus for installing and removing a plumbing fitting such as a sink strainer nut that allows the sink strainer nut to be quickly and easily replaced.

SUMMARY OF THE INVENTION

The present invention concerns an apparatus for installing and removing a plumbing fitting such as a sink strainer nut. The apparatus is a wrench including a collar portion and a handle portion pivotally attached to the collar portion. The collar portion defines a plurality of cutouts and engaging surfaces for engaging with lugs on a sink strainer nut.

The apparatus in accordance with the present invention is designed for easy and quick installation or removal of the sink strainer nut, fits in places that allow a minimum turning space, and eliminates wrench slippage and the corresponding loss of valuable time while working. The apparatus in accordance with the present invention provides an inexpensively produced, high quality, portable tool for use in removing sink basket strainer retaining nuts.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
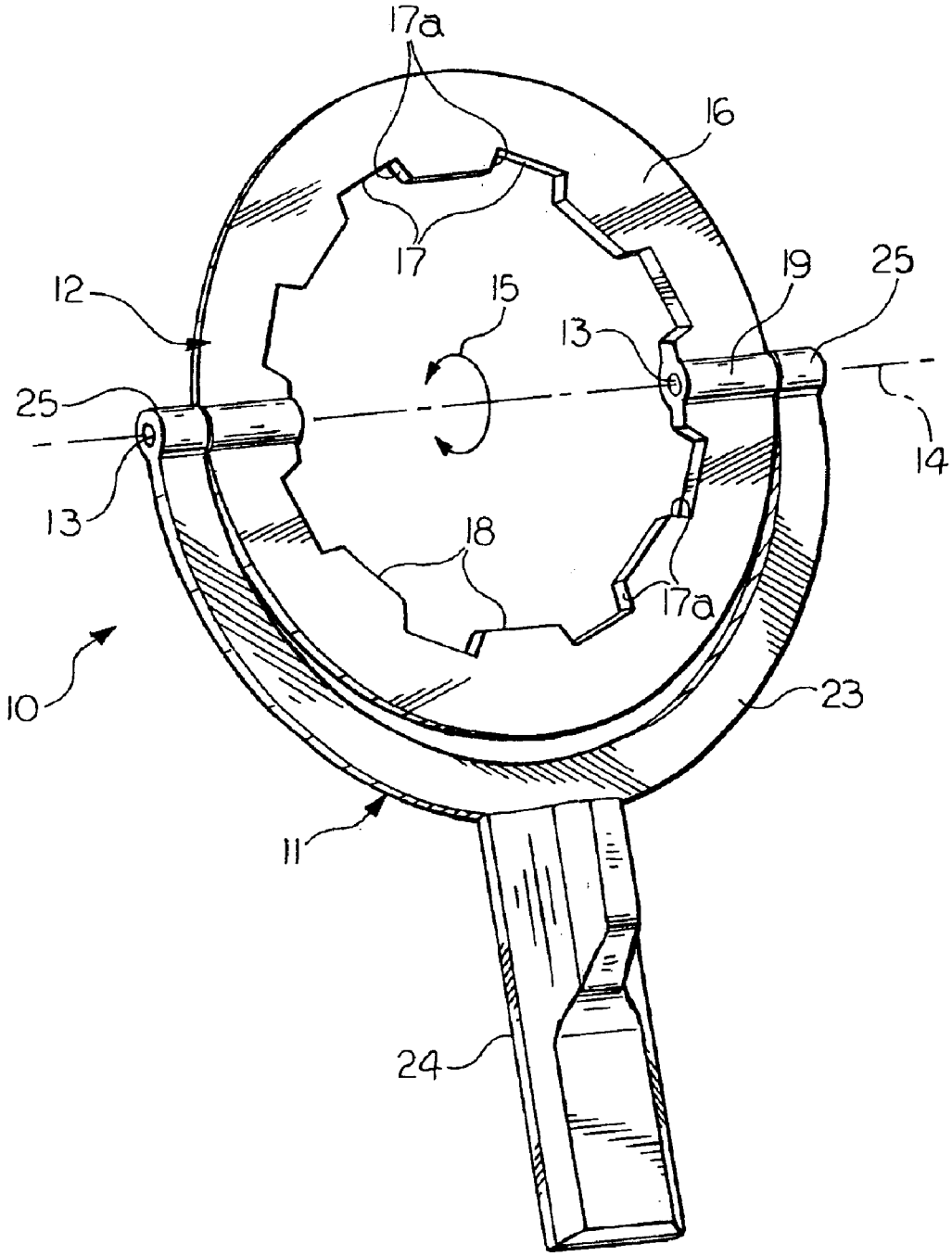
FIG. 1 is a perspective view of a tool in accordance with the present invention.
Figure 2:
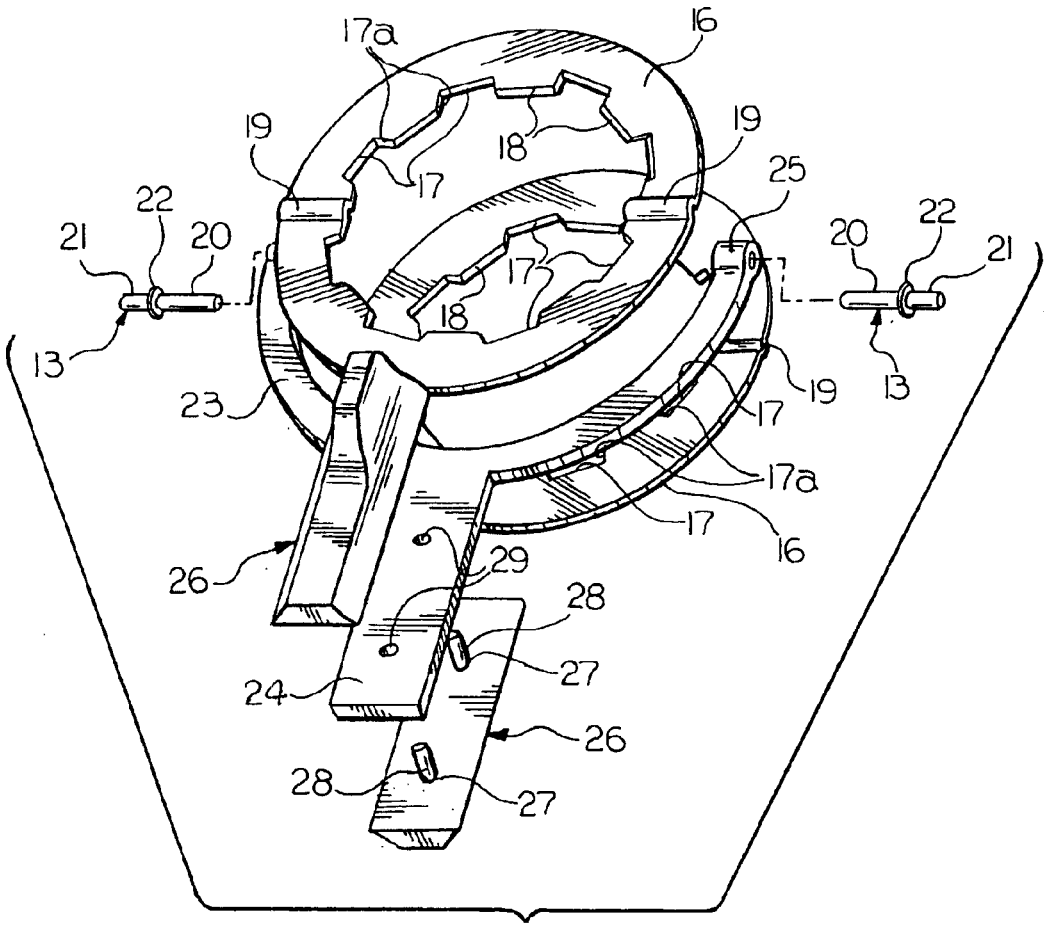
FIG. 2 is an exploded perspective view of the tool shown in FIG. 1.
Figure 3:
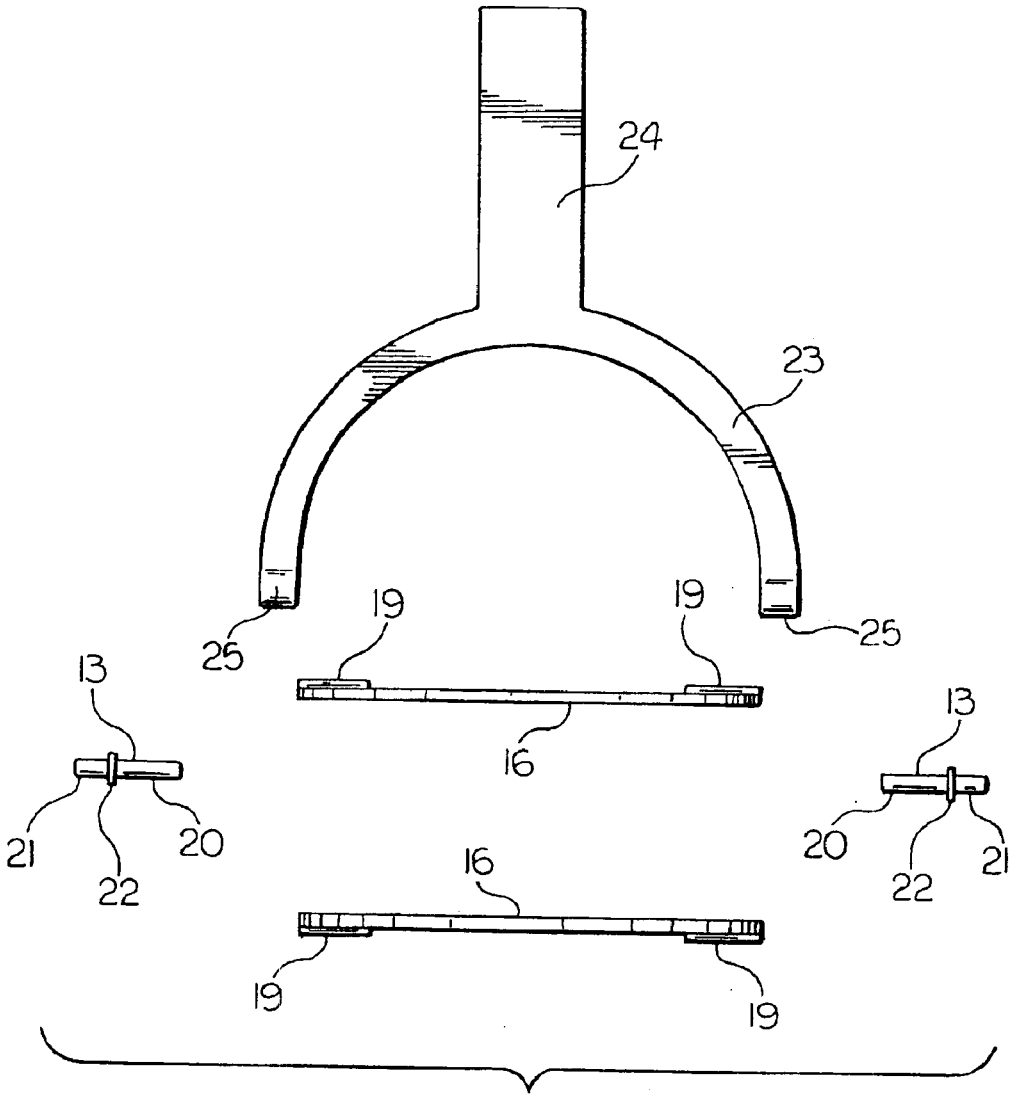
FIG. 3 is an exploded plan view of the handle of the tool shown in FIG. 1.

As shown in FIGS. 1 through 3, a tool 10 according to the present invention includes a handle 11 and a collar 12. The collar 12 is rotatably attached to the handle 11 by a pair of pivot pins 13. The pivot pins 13 are aligned on an axis of rotation 14 whereby the handle 11 and the collar 12 can rotate relative to one another 360° in either direction as indicated by an arrow 15.

Figure 5:
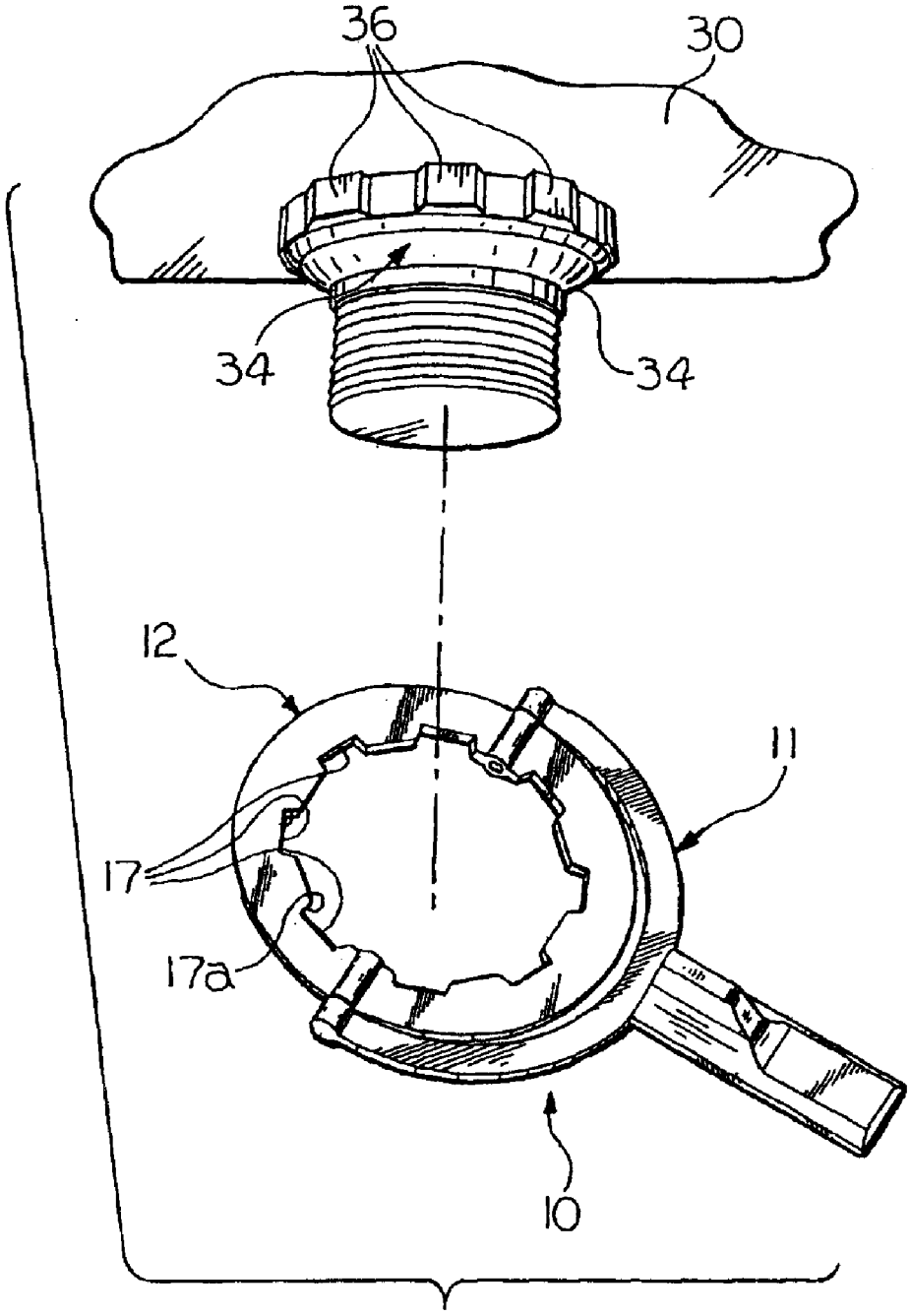
FIG. 5 is a perspective view of the tool shown in FIG. 1 adjacent a sink strainer nut.

The tool 10 is adapted to engage with a plumbing fitting such as a sink strainer retaining nut 34, best seen in FIG. 5. The strainer nut 34 includes radially outwardly extending lugs 36 on an outer surface thereof and is shown attached to a strainer basket 32 extending through an aperture (not shown) in a sink 30.

The collar 12 is formed by a pair of generally planar rings 16 each having a plurality of cutouts 17 formed in an inner diameter edge 18 thereof. The diameter of the edge 18 and the dimensions and spacing of the cutouts 17 are selected to cooperate with the lugs 36 on a typical sink strainer nut, such as the strainer nut 34 shown in FIG. 5. Each of the cutouts 17 defines engaging surfaces 17*a* for engaging with respective outer surfaces of the lugs 36 of the strainer nut 34, discussed in more detail below. Thus, the collar 12 may be provided in different sizes if required. Each of the rings 16 has a pair of outwardly extending wall portions 19 that form one half of a tubular seat for the pivot pins 13. While the inner diameter edge 18 and the corresponding cutouts 17 are shown defining a generally circular opening having rectangular cutouts, those skilled in the art will appreciate that the size and shape of the opening defined by the inner diameter edge 18 may be varied and the number and size of the cutouts 17 may be varied to engage with any type or shape of nut-like fastener. For example, the cutouts could be V-shaped or flats or complex curves to match a configuration of an outer surface of a fastener to be engaged.

The pivot pins 13 each have a longer shaft portion 20 rotatably retained between the facing wall portions 19 and a shorter shaft portion 21 retained by the handle portion 11 as described below. A radially extending flange 22 separates the portions 20 and 21 and abuts the outer periphery of the ring 16 to prevent the pivot pin 13 from sliding inwardly through the tubular seat formed by the facing wall portions 19.

The handle 11 has a generally planar U-shaped leg portion 23 formed integrally with a generally planar shaft portion 24. The leg portion 23 has a pair of free ends 25 of tubular construction for receiving the associated shaft portion 21. The flanges 22 of the pivot pins 13 abut the respective inner faces of the free ends 25 to prevent the pivot pins 13 from sliding outwardly. The length of the shaft portion 24 is sized long enough to permit a used to apply enough torque to remove the nut 34 during use of the tool 10 and yet short enough to be used in confined spaces, such as between 4 and 6 inches in length, which also makes the tool 10 an easily portable tool.

The handle 11 and the collar 12 can be assembled by inserting the shorter shaft portion 21 of each pivot pin 13 into the aperture of the associated free end 25 until the flanges 22 abut the free ends. Then the two rings 16 are positioned between the free ends with the wall portions 19 aligned with the longer shaft portions 21 and the rings are fastened together by any suitable means such as, but not limited to, adhesive, ultrasonic welding or mechanical means. When the tool 10 is assembled, the handle 11 and the collar 12 are free to rotate with respect to one another about the pivot pins 13.

Figure 4B:
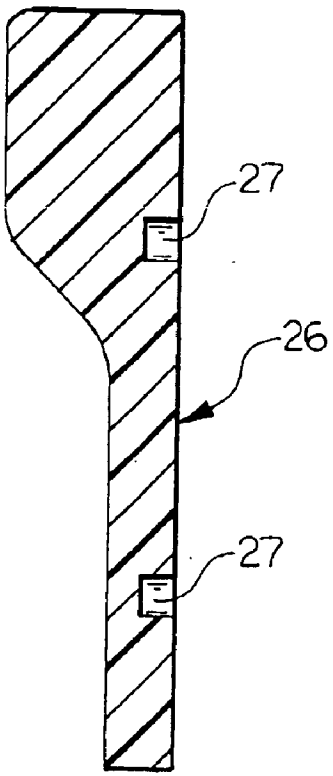
FIG. 4B is a cross sectional view of the handle grip shown in FIG. 4A taken along the line 4B—4B.
Figure 4A:
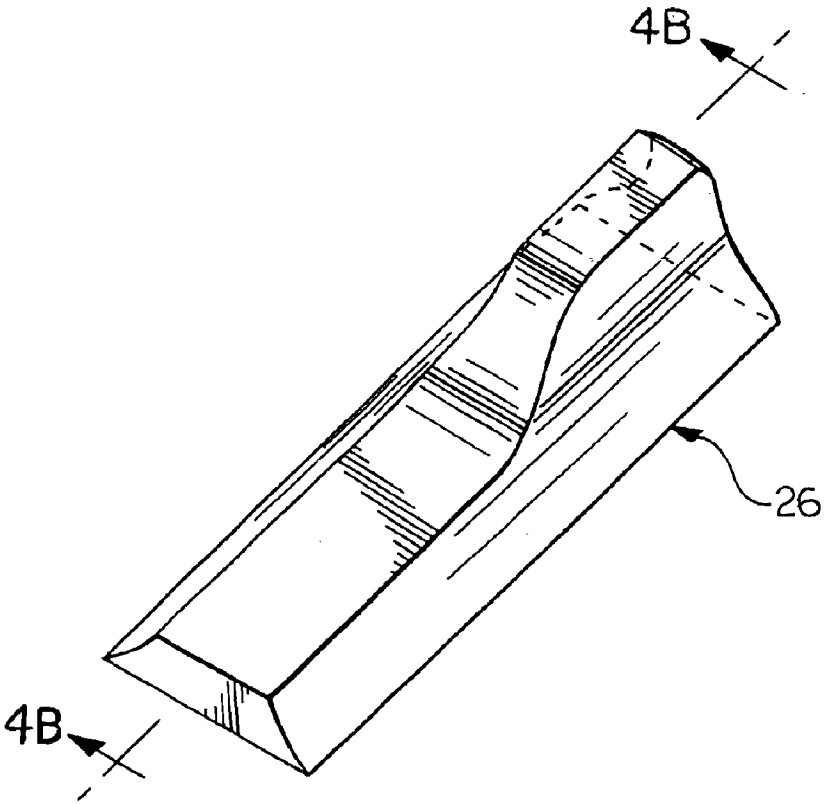
FIG. 4A is a perspective view of the handle grip shown in FIGS. 1 and 2.

The shaft portion 24 extends radially from an edge of the leg portion 23 midway between the free ends 25. The shaft portion 24 of the handle 11 includes a pair of grips 26 (FIGS. 4A and 4B) each having a pair of apertures 27 formed in a rear surface thereof. The apertures 27 receive pegs 28 (FIG. 2) that can be a press fit. The apertures 27 are spaced to permit the pegs 28 to extend through a pair of holes 29 formed in the shaft portion 24 to attach the grips 26 to opposite faces of the shaft portion 24. Alternatively, other types of fasteners, such as screws, or nuts and bolts (not shown), may be placed in the holes 29 to fasten the grips 26 to the shaft portion 24 of the handle 11.

In operation, the collar 12 of the tool 10 is placed over the strainer basket 32 of the sink 30 and on the nut 34. A torque is applied to the tool 10 at the handle 11 to rotate the nut 34 in either of an engaging or a disengaging direction. When the torque is applied to the tool 10, each of the engaging surfaces 17*a* of the cutouts 17 may engage with a corresponding lug 36 of the nut 34, providing a greater amount of torque on the nut 34 and advantageously reducing the likelihood of the tool 10 slipping during use. The pivot pins 13 allow the handle 11 to be rotated in the direction 15 about the rotational axis 14 in order to avoid objects under the sink while the engaging surfaces 17*a* of the collar 12 remain engaged with the lugs 36 on the nut 34 in a manner similar to that of a socket breaker bar. This allows the tool 10 to be utilized in a confined space and provides the ability to remove the nut 34 quickly without requiring the tool 10 to be engaged and disengaged repeatedly and reducing the amount of time required to remove the nut 34 completely.

The tool 10 can be formed from any suitable material or combination of materials. For example, the handle 11, the collar 12 and the pivot pins 13 can be formed from the same or different plastic materials. The pivot pins 13 and/or the leg portion 23 and the shaft portion 24 can be formed of a metal material. Alternatively, the handle 11, the collar 12, and the pivot pins 13 can be formed of a metal material. The grips 26 can be formed from a rubber material, a plastic material, or similar material able to be easily gripped by a human hand. Preferably, the collar 12 is permanently attached to the handle 11, providing a compact tool 10 that is able to fit in tightly enclosed spaces. Alternatively, the collar 12 is releasably attached to the handle, allowing for various sized collars 12 to be attached to the handle 11 and allowing nuts, such as the nut 34, of varied diameter to be removed and installed with the tool 10.

Figure 6:
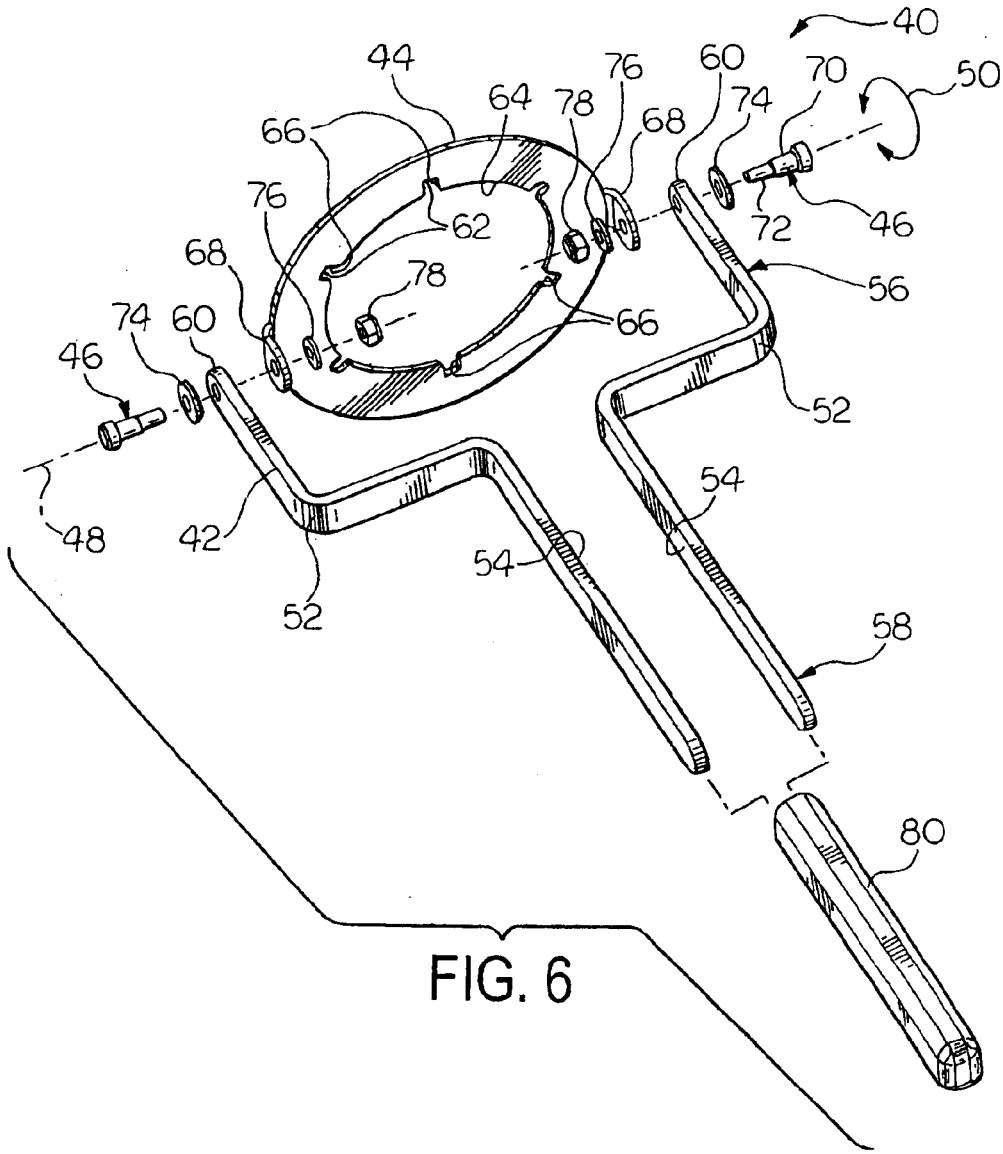
FIG. 6 is an exploded perspective view of an alternative embodiment of a tool in accordance with the present invention.

Referring now to FIG. 6, an alternative embodiment of a tool in accordance with the present invention is indicated generally at 40. The tool 40 includes a handle 42 and a collar 44. The handle 42 is rotatably attached to the collar 44 by a pair of pivot pins such as shoulder bolts 46. The shoulder bolts 46 are aligned on an axis of rotation 48 whereby the handle 42 and the collar 44 can rotate relative to one another in a 360° rotation as indicated by an arrow 50.

The handle 42 is formed of a pair of generally S-shaped members 52 that are attached to each other on respective planar mating surfaces 54, such as by welding or the like. When attached, the members 52 form a generally planar U-shaped leg portion 56 and a generally planar shaft portion 58. The leg portion 56 has a pair of free ends 60 having apertures extending therethrough for receiving the shoulder bolts 46.

The collar 44 is formed of a single piece of metal, such as a metal stamping or the like, having a plurality of cutouts 62 formed in an inner edge 64 thereof. The diameter of the edge 64 and the dimensions and spacing of the cutouts 62 are selected to cooperate with the lugs on a typical sink strainer nut, such as the strainer nut 34 shown in FIG. 5. Each of the cutouts 62 defines engaging surfaces 66 for engaging with respective outer surface of the lugs 36 of the strainer nut 34, discussed in more detail below. Thus, the collar 44 may be provided in different sizes if required. The collar 44 includes a pair of axially downwardly extending flanges 68 having apertures extending therethrough for engaging with the free ends 60 of the handle 42 and for receiving the shoulder bolts 46 when the handle 42 and the collar 44 are rotatably attached together.

The shoulder bolts 46 include a large diameter portion 70 adjacent the bolt head and a small diameter portion 72 adjacent the free end thereof. When the handle 42 and the collar 44 are rotatably attached together, the apertures in the free ends 60 and the flanges 68 are aligned. A first washer 74 having an aperture conforming to the larger diameter portion 70 is placed adjacent an outer surface of the free ends 60 and a second washer 76 having an aperture conforming to the smaller diameter portion 72 is placed adjacent an inner surface of the flanges 68. The shoulder bolts 46 are passed through the respective apertures in the washer 74, the free end 60, the flange 68, and the washer 76 and is threadably engaged with a lock nut 78 adjacent the washer 76. The handle 42 and the collar 44 are free to rotate with respect to one another on the large diameter portion 70 of the shoulder bolts 46. A handle grip 80 is preferably formed of a PVC material or a similar material and encapsulates a substantial length of the shaft portion 58 of the handle 42. Preferably, the handle grip 80 is formed after the members 52 have been joined by immersing the shaft portion 58 in a source of liquid PVC or the like. The outer surface of the members 52 is preferably zinc-coated to provide a surface upon which the PVC of the handle grip 80 may adhere more easily.

In accordance with the provisions of the patent statutes, the present invention has been described in what is considered to represent its preferred embodiment. However, it should be noted that the invention can be practiced otherwise than as specifically illustrated and described without departing from its spirit or scope. For example, while the tools 10 and 40 have been described for use with sink strainer nuts, those skilled in he art will appreciate that the apparatus in accordance with the present invention can be utilized for many types of plumbing fittings or fasteners having lugs, such as the lugs 36 shown in FIG. 5, extending from an outside diameter thereof for installation and removal of the fitting or fastener.

What is claimed is:

1. An apparatus for installing and removing a nut comprising:

an annular collar sized to extend about an outer surface of a nut and having an inner edge with a plurality of cutouts adapted for engaging the outer surface of the nut;

a handle pivotally attached to said collar; and a pair of pivot pins pivotally connecting said handle to said collar, each said pivot pin having a radially extending flange formed thereon for engaging said handle and said collar to prevent movement along an axis of rotation.

2. The apparatus according to claim 1 wherein said handle pivots on an axis of rotation extending along a diameter of said collar.

3. The apparatus according to claim 1 wherein said collar is formed from two flat rings attached together.

4. The apparatus according to claim 1 wherein said handle includes a pair of grips attached to a shaft portion.

5. The apparatus according to claim 4 wherein said grips are attached to said shaft portion by a pair of fasteners.

6. The apparatus according to claim 5 wherein said pair of fasteners is a pair of pegs.

7. An apparatus for installing and removing a sink strainer nut comprising:

a collar having an aperture sized to extend about a sink strainer nut and having a plurality of cutouts at an inner edge defining a plurality of engaging surfaces for engaging respective lugs on the sink strainer nut, said collar having a pair of substantially tubular seats;

a handle having a pair of free ends; and a pair of pivot pins received in said tubular seats and in free ends, said pivot pins pivotally attaching said collar to said handle.

8. The apparatus according to claim 7 wherein said collar is formed of a pair of opposed planar ring portions.

9. The apparatus according to claim 7 wherein said handle is formed of a pair of generally S-shaped members.

10. The apparatus according to claim 7 wherein said handle includes an integrally formed leg portion and shaft portion.

11. The apparatus according to claim 7 wherein each said pivot pin has a radially extending flange formed thereon to prevent movement along an axis of rotation.

12. The apparatus according to claim 7 wherein said collar is annular and said handle pivots on an axis of rotation extending along a diameter of said collar.

13. The apparatus according to claim 7 wherein said collar is formed from a flat ring.

14. The apparatus according to claim 7 wherein said handle includes a pair of grips attached to a shaft portion.

15. The apparatus according to claim 14 wherein said grips are attached to said shaft portion by a pair of fasteners.

16. The apparatus according to claim 15 wherein said pair of fasteners is a pair of pegs.

* * * * *